US006591965B2

(12) United States Patent
Smith, Jr. et al.

(10) Patent No.: US 6,591,965 B2
(45) Date of Patent: Jul. 15, 2003

(54) ITEM HANDLER FOR SORTING AND PACKING

(75) Inventors: Ronald Dean Smith, Jr., McCook, SD (US); Larry W. Fallin, Dakota Dunes, SD (US); Andrew S. Courier, Mansfield, MA (US); Stephen N. Forti, Stoneham, MA (US); William G. Leary, Upton, MA (US)

(73) Assignee: IBP, Inc., Dakota Dunes, SD (US)

( * ) Notice: Subject to any disclaimer, the term of this patent is extended or adjusted under 35 U.S.C. 154(b) by 0 days.

(21) Appl. No.: 10/180,447

(22) Filed: Jun. 26, 2002

(65) Prior Publication Data

US 2002/0157926 A1 Oct. 31, 2002

Related U.S. Application Data

(62) Division of application No. 09/452,954, filed on Dec. 12, 1999, now abandoned.

(51) Int. Cl.[7] ..... B65G 47/24
(52) U.S. Cl. ..... 198/409; 198/463.3
(58) Field of Search ..... 198/409, 410, 198/463.3

(56) References Cited

U.S. PATENT DOCUMENTS

| | | | | |
|---|---|---|---|---|
| 1,887,211 A | | 11/1932 | Mortimer | |
| 2,485,040 A | | 10/1949 | Cupo | 93/6 |
| 2,649,058 A | | 8/1953 | Holbeck | 107/57 |
| 2,674,762 A | | 4/1954 | Zaenkert | 17/16 |
| 2,769,557 A | | 11/1956 | Ohr | 214/1 |
| 3,049,247 A | | 8/1962 | Lemelson | 214/16.4 |
| 3,225,891 A | | 12/1965 | Hickin et al. | 198/31 |
| 3,246,733 A | | 4/1966 | Torbet et al. | 198/185 |
| 3,302,803 A | | 2/1967 | Mooney | 214/1 |
| 3,403,794 A | | 10/1968 | Lopez | 214/16.6 |
| 3,456,773 A | | 7/1969 | Titmas | 198/20 |
| 3,593,862 A | | 7/1971 | Pierson et al. | 214/11 R |
| 3,595,415 A | * | 7/1971 | Herd et al. | 214/711 |
| 3,627,106 A | | 12/1971 | Winfield | 198/34 |
| 3,730,326 A | | 5/1973 | Irving, Jr. et al. | 198/33 |
| 3,752,330 A | | 8/1973 | Whitmill | 214/1 |
| 3,820,667 A | | 6/1974 | Critchlow et al. | 214/1 BT |
| 4,089,017 A | * | 5/1978 | Buldini | 354/81 |
| 4,101,020 A | | 7/1978 | Langen | 198/478 |
| 4,232,777 A | | 11/1980 | Smith et al. | 198/404 |
| 4,475,630 A | * | 10/1984 | Jackson et al. | 187/9 R |
| 4,492,504 A | | 1/1985 | Hainsworth | 414/273 |
| 4,615,429 A | | 10/1986 | Arase | 198/456 |
| 4,616,820 A | * | 10/1986 | Thompson et al. | 271/189 |
| 4,629,057 A | | 12/1986 | Jensen et al. | 198/424 |
| 4,642,016 A | | 2/1987 | Bucher et al. | 414/421 |
| 4,699,564 A | | 10/1987 | Cetrangolo | 414/765 |
| 4,756,657 A | | 7/1988 | Kinney | 414/281 |
| 4,798,278 A | | 1/1989 | Cornacchia | 198/399 |
| 4,829,634 A | | 5/1989 | Keith et al. | 17/24 |
| 4,878,798 A | | 11/1989 | Johansson | 414/280 |
| 4,910,944 A | * | 3/1990 | Segalowitz et al. | 53/586 |
| 5,024,572 A | | 6/1991 | Tanaka et al. | 414/276 |
| 5,129,777 A | | 7/1992 | Pohjonen | 414/280 |
| 5,226,782 A | | 7/1993 | Rigling | 414/283 |
| 5,263,302 A | | 11/1993 | Hauers et al. | 53/544 |
| 5,275,272 A | | 1/1994 | Ydoate | 198/367 |
| 5,362,197 A | | 11/1994 | Rigling | 414/786 |
| 5,380,139 A | | 1/1995 | Pohjonen et al. | 414/280 |
| 5,421,685 A | | 6/1995 | Elmer et al. | 414/280 |
| 5,489,016 A | | 2/1996 | Welch | 198/347.2 |
| 5,558,483 A | | 9/1996 | Masuda | 414/278 |
| 5,564,879 A | | 10/1996 | Noguchi | 414/268 |
| 5,626,453 A | | 5/1997 | Bouche | 414/280 |
| 5,725,082 A | | 3/1998 | Connell | 198/471.1 |

* cited by examiner

*Primary Examiner*—Christopher P. Ellis
*Assistant Examiner*—Rashmi Sharma
(74) *Attorney, Agent, or Firm*—Mark E. Stallion; Blackwell Sanders Peper Martin LLP

(57) ABSTRACT

An item handling system that sorts and packs items in a storage or shipping receptacle. The system is specifically designed to handle items such as sub-primal cuts of beef or pork or items of like size and weight. The system is adapted to sort items based on product type or based on system capacity. The packing mechanism is adapted to properly orient the item prior to placing the item in the storage or shipping receptacle. The system is specifically adapted to handle cardboard shipping boxes.

13 Claims, 9 Drawing Sheets

ITEM HANDLER FOR SORTING AND PACKING

CROSS-REFERENCE TO RELATED APPLICATION

This application is a divisional application of U.S. application Ser. No. 09/452,954 filed Dec. 12, 1999 Now abandoned entitled Item Handler For Sorting and Packing.

BACKGROUND OF THE INVENTION

1. Field of the Invention

This invention relates to automatic item handling systems and methods for the sorting of a product item and the packing of said product item into a receptacle where packing of the item is performed by spatially manipulating the item to an optimal orientation prior to depositing it into a storage or packing receptacle for the most efficient usage of the receptacles storage volume. More specifically, the invention relates to such an automatic item handling apparatus and methods where the item is a type of now conforming material, such as a subprimal cut of meat, to be packed in a cardboard packing box.

2. Related Art

There is a need for an automated item handling system for meat packing facilities, or other like facilities, where the item handler can automatically pack items in packing receptacles while filling the volume of the receptacle with product items in a pre-defined orientation and without the need for manual interaction. Item handling systems generally perform the function of capturing an item in the manufacturing flow and operating on it and manipulating it in such a way as to prepare it or spatially position it for the next series of operations in the manufacturing flow. In the case of an item handling system that has the specific function of packing an item or multiple items into a storage receptacle or a simple packing box, there are several key objectives that must be achieved in order to develop an effective item handling system. It is desired that an item handling system for the purpose of packing will have the flexibility to handle various types of items and quantity of items to be packed. The types of items can vary in size, shape, and weight and the quantity to be packed can vary for a given receptacle. It is also desired that an item handling system has the ability to automatically deposit an item into a receptacle or box with a specific positional orientation which is based on the size and shape of the item, and each item has its own orientation such that the interior storage volume of the receptacle or box is utilized most efficiently and guarantees quality of product. Another desire is that the item handling system will pack same-type items into receptacles of various volumes.

A typical automated item handler/packing device that is utilized in a factory environment is integral with a network of conveyors that transport items to and from the sorting and packing stations. In the art area of package handling or item handling, a conveyor has been traditionally employed to forward a package from one work-station to another in order to accomplish the various handling functions. In many factory operations the work stations for placing an item in a storage receptacle or a shipping container are totally manual operations. In other factory operations the work-stations are somewhat more automated but still have limitations that negatively effect the efficiency and the cost of the packaging function.

For example, U.S. Pat. No. 4,798,278 issued Jan. 17, 1989 to Gornacchia addresses a conveyor system that has the ability to turn packages upside down in a very gentle fashion. The conveyor device is interposed in line with a separate feed conveyor and discharge conveyor. The device receives a package from a feed conveyor and then turns the package upside down and discharges the package onto a subsequent discharge conveyor. The conveyor includes a rotateable turning element which receives at least one package and an intermittent rotational mechanism which tumbles the turning element in rotation. This mechanism allows the package to be turned upside down without actually gripping the package with a gripping mechanism. This patent is similar to the subject invention in that the apparatus of this patent allows an item to be positionally manipulated in order to automatically facilitate the handling of said item. However, the apparatus of this patent does not address the needs as satisfied by the subject invention. There is a need in the art area for an automated apparatus that has the ability to positionally/spacially manipulate an item and discharge the item to a specific location whether within a receiving receptacle or other container. Also, for greater flexibility and efficient use of the receptacles volume, the system should have the ability to position a receptacle unit, specifically a packing box, at the proper location such that the item to be packaged can more readily be placed in said receptacle at a specific location. The conveyor belt in the case of the referenced patent is actually utilized to manipulate the position of the item by flipping it upside down. However, the limited ability to flip an item upside down is a spatial manipulation that in many cases will not be adequate to position an item to be packed in a receptacle in the most efficient manner.

Another example of item handling is shown in U.S. Pat. No. 4,699,564 issued Oct. 13, 1987 to Cetrangolo which addresses an apparatus that has the ability to rotate a heavy object 180°. The device comprises a set of spaced parallel circular conveyor tracks that have an ability to rotate 180° on roller bearings. The parallel circular roller conveyor tracks line the top and bottom faces of a slot defined by said tracks. When the parallel tracks are rotated 180° end-over-end, any heavy object currently resting on the lower track will be transferred to the upper track, which will become the bottom track once the 180° rotation is complete. The center of gravity of the loaded turning apparatus coincides with the center of rotation, thereby requiring very little turning power. Traverse rollers permit entry and exit of a heavy object at opposite ends of the slot defined by the roller tracks. Once the 180° rotation is complete, any object that rests on the lower track (formerly upper) will have been flipped upside down. At that point, the object can exit the slot via the roller tracks and be transported on to an integral conveyor for carriage to the next station. However, this apparatus does not have the ability to directly deposit the item into a packing receptacle, thus an additional step and mechanism is required. Also, as noted with Cornacchia, '278 above the limited ability to flip the item over in many cases will not be adequate to position an item to be packed in a receptacle in the most efficient manner.

A slightly different approach to this item handling problem is shown in U.S. Pat. No. 5,263,302 issued Nov. 23, 1993 to Hauers which addresses a device for packing receptacles with complimentary shapes. That is, when the receptacle is rotated 180° laterally with respect to an adjacent receptacle, the meeting portions of the receptacles have complimentary shapes and contours. These specially-shaped receptacles or containers allow for items to be efficiently packed in a receiving receptacle or box. The embodiment described in the cited patent utilizes the method of rotating the receiving receptacle or box 180° instead of actually rotating the complimentary shaped receptacles. The receiving receptacle and/or the box is rotated 180° each time a new complimentary shaped unit is deposited in said receiving unit or box. The apparatus described in the cited patent requires that a special type of package be utilized in order to implement this packing. This will result in a significant cost increase particularly if different size product items are being utilized.

It should also be noted that the above cited patents do not address an integral sorting function that is needed to handle different product types and to control capacity flow to a given packing station. A better approach is needed.

A way is needed to reliably sort items based on their varying shapes, weights and sizes, or sort items due to a given flow path reaching its limited capacity. After said sorting function, there is still a need for the item handler to then automatically pack the items in receiving receptacles or packing boxes of various volumes in an efficient space saving manner.

SUMMARY OF THE INVENTION

It is in view of the above problems that the present invention was developed. It is an object of this invention to sort items by type and more efficiently pack the item in a storage receptacle or a shipping container such as a cardboard box.

It is also an object of this invention to better automatically three-dimensionally spatially manipulate an item so that an item can be deposited into a receptacle in such a way as to make the most efficient use of the internal receptacle volume and to assure quality packing of the product.

It is also an object of this invention to receive an empty receptacle and position it for more efficient insertion of items therein than was performed by prior devices.

It is also an object of this invention to more reliably automate a packaging facility.

It is also an object of this invention to sort product items to control the volume of product flow down a given path and to optionally segregate product paths by type.

It is also an object that the product items can be dynamically reassigned to a different product staging station also known as the packing station.

It is also an object of this invention to passively conform to a given products size and weight when executing its packing methods.

The invention satisfies the above objects by providing a method and apparatus for positioning a receptacle and three dimensionally manipulating a product item for packaging to a spatial position so that depositing the product item in said receiving receptacle can be performed in a more efficient manner. The apparatus of the present invention is a modular packing manipulator and more preferably a sorter, selector, manipulator, placer and packer for packing vacuum-packed sub-primal cuts of meat into packing boxes. The apparatus can also be used to pack other vacuum packed meat products such as various ground beef products. The above invention preferably is a software controlled item handling method that automatically sorts and packs sub-primal cuts of meat into boxes.

We noted that past efforts to design item handling systems to automate and facilitate packing of items have concentrated largely on the ability to flip the item upside down or to translate the unit from one conveyor to another. Also, trap door mechanisms have been implemented to drop the item into a box. In addition we noted that some methods to facilitate packing have relied on the shape of special prepacked cartons such that when the packing box is automatically rotated 180 degrees in alternating fashion the specially complimentary shaped cartons conform together in order to conserve volume.

We chose not to employ the above methods because they are limited in that the manipulator of the item to be packed only provides two dimensional translation of the item instead of three dimensional translation. This limitation restricts the shape of the item and/or number of types of items that can be manipulated by a given manipulator. More flexibility in an item handling system is desired.

In addition, a problem faced is that in a meat packing environment there may be several different product types (sub-primal cuts of meat) of widely varying sizes, weights and shapes that have to be handled and packed. Also, for a given product item there may be several different packing quantities, e.g. five primal cuts per a large box as opposed to three cuts per a small box. The total number of pieces to be placed into the box may also vary depending on the size of individual items for a given product item and box size. The size and weight for a given product item, such as a sub primal cut, can also vary all of which makes adaptability of the fixture very important. It is desirable to have one manipulator model that can handle any of the product items with which a system may have to handle.

The sorting functions and manipulator functions are all preferably software controlled. The sort that is performed and the manipulation that is performed can be determined by the product type. The product type can be input manually or by some automated means such as bar code sensing. Once the product type has been input specific routines may be executed to accomplish the packing.

The inventor has determined that three dimensional manipulation and initial sorting is necessary for an effective automated meat packing system and these are the keys to the inventor's method and apparatus.

BRIEF DESCRIPTION OF THE DRAWINGS

The advantages of this invention will be better understood by referring to the accompanying drawing, in which.

DESCRIPTION OF THE INVENTION

Figure 1:
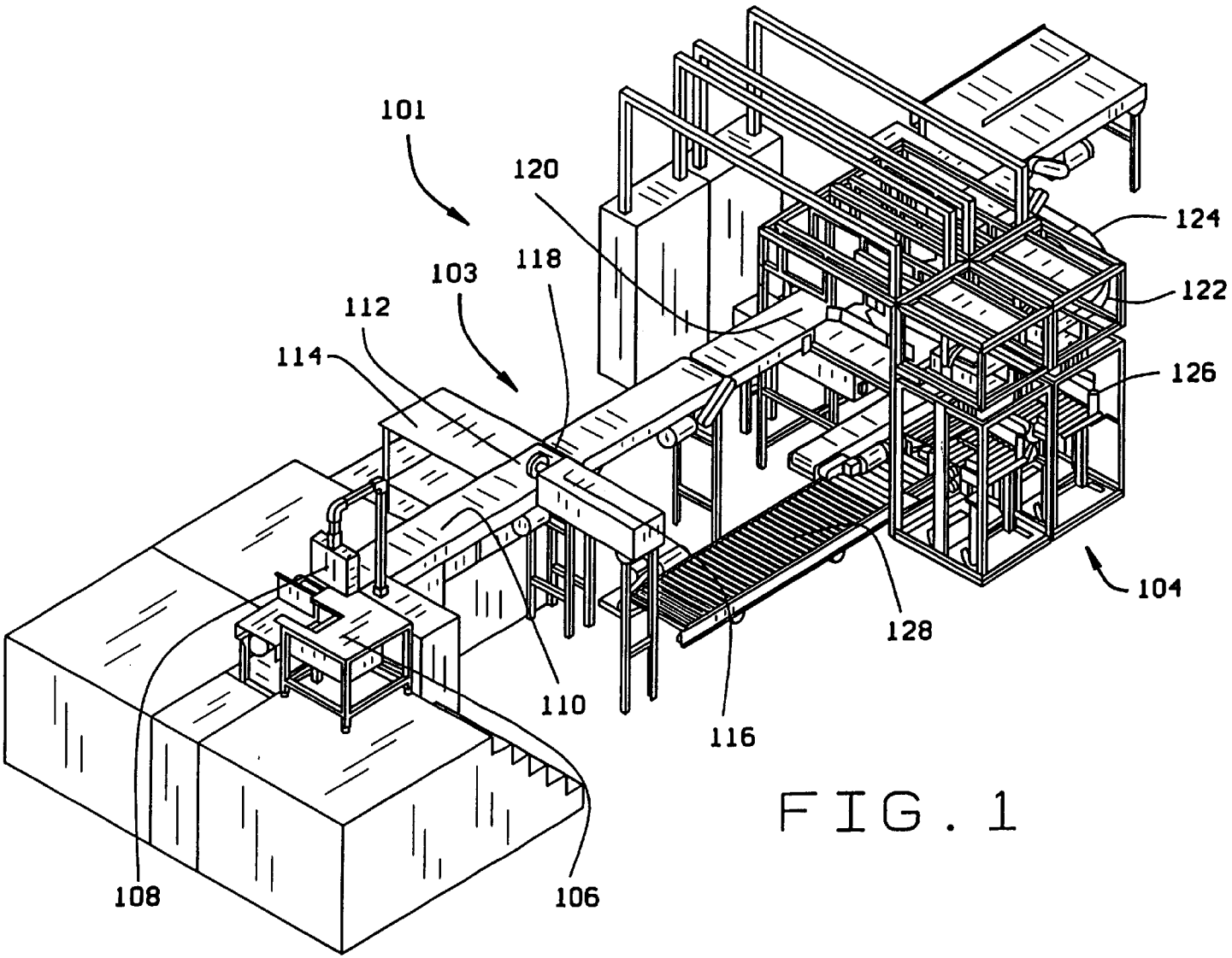
FIG. 1 shows a top-right front perspective view of the overall system of a preferred exemplary embodiment of the invention.

The automated packing system, such as that best mode shown in the drawings or other embodiment within the scope of the appended claims, comprises several stages or groups of sub-steps.

In the first sorting stage, the vacuum packed primal cuts of meat are sorted by a system of conveyors and kicking devices which convey the product item to the appropriate robot manipulator bank based on product type and manipulator capacity. Early in this stage, a branch kickoff apparatus, which is in-line with the conveyor, performs initial sorting.

The branch kickoff apparatus sorts by laterally translating selected items on to another secondary branch conveyor path which either leads to a waiting and hold station for manual handling (accumulation station) or leads to a second bank of manipulators. As an option the accumulation station or waiting and hold station can be fully automated such that items are temporarily held and then automatically released back into the process flow once volume allows. One function of the accumulation station is to transfer low volume product items or high weight items to the accumulation station and then inserted back in to the process flow when needed. The branch kickoff apparatus is adapted to transversely extend across the conveyor. Once initial sorting occurs, the cuts of meat can in this way be conveyed down various conveyor belts that lead to the appropriate pack-off robot manipulator for a second stage. If no sorting occurs at this stage the conveyor conveys the product item to the primary manipulator bank to begin the selection stage.

To perform the secondary sorting of the selection stage, a manipulator bank can comprise several pack-off robot manipulators and a secondary sorting or selection function can be performed at the inlet of a given manipulator bank. Hereforth this secondary sorting will be termed the "selection" stage. Preferably, a manipulator bank may comprise a row of two or more manipulators contained in an orientor module and between each manipulator inline to the conveyor there is optionally a stopping plate that drops down to stop the item adjacent to the desired manipulator. When the stopping plate stops the item a kicker or other similar apparatus kicks the item laterally off the conveyor to a staging point adjacent the inlet of the chute of the manipulator. As the piece of meat or other product item travels down the conveyor, it can thus be kicked to a staging point where it can then be translated into the manipulator's inlet chute when in position. The term "pack-off robot" is used to encompasses the stepping plate, the kicker, the orientor module, the elevator module and the manipulator module.

We will call the following action the product item placement stage. In this product item placement stage, once the meat is positioned appropriately; the chute can be tipped toward the opposite end opening and the radially extendable bladder member an pressure plate interior holding device is retracted, such that the product is released and dropped into the receptacle. In this way the manipulation stage and workpiece portion of the product item placing stage are combined.

The invention also comprises a receptacle handling module to place the box or other receptacle into the proper position to receive the item from the manipulator chute. This function is referred to as the receptacle placement stage. The receptacle handling system comprises a receptacle handling elevation table that receives, grasps, and positions a packing receptacle appropriately by raising the receptacle to the necessary height and tilting appropriately for deposit of the sub-primal cuts of meat.

Referring to FIG. 1, the top-side view of the overall item handling system 101 including a conveyor system 103 and a primary bank 104 of manipulators is shown. An operator control station 106 is the point that the various product items enter into the conveyor system 103 of the item handling apparatus. There is an operator control panel 108 shown. The operator control panel allows the operator (not shown) to define the product items that are currently being input into the item handling conveying system. The operator's control panel selection would cause the initiation of software routines which will control the item handling conveying system and manipulator system. Once the product type has been defined and the software routine have been initiated, the product item travels down the item receiving input conveyor 110 from the input portion on the operator control station side of the receiving input conveyor to the output portion.

The product item is then conveyed past an accumulation station 112. At this point, products may be rerouted in any appropriate manner down a secondary branch conveyor (not shown) to a secondary bank of manipulators (not shown but similar to the one shown in this Figure) or may be rerouted to an accumulation table 114 for manual handling and disposition. This is referred to above as the sorting stage.

Rerouting of the product items occurs when the primary bank 104 of manipulators have reached their maximum capacity and/or the secondary bank of manipulators have been predisposed to handle that particular product item. Rerouting is also used to accumulate low volume pieces or high weight pieces. The rerouting occurs when an accumulation or branch kicker 116 laterally displaces the product item onto the accumulation table 114 for manual handling or when the accumulation kicker 116 laterally displaces the product item onto a secondary branch conveying system, (not shown). The kicker 116 has a rod like member 118 with an over-sized blunt end, preferably a T-shaped end, that selectively extends laterally across the conveyor to kick the item off. This selective extension of member 118 serves as the initial sorting stage as noted earlier. The secondary conveying system would lead to an identical bank of manipulators which is not shown in this figure.

If the product item is conveyed without rerouting at the accumulation station, the product item is conveyed to the product staging station 120. An actuated hinged diverter plate or door (not shown) will swing down or across to stop the product item adjacent to the selected manipulator. The hinged door provides a secondary sorting function by stopping the production at the appropriate manipulator and starts the selection stage referred to earlier. It is at this point that the product item is laterally displaced into an orientor module 122 starting the manipulator stage as referred to above and then the product item is inserted into one of the manipulator chutes within the bank of manipulators. This occurs in a three step mechanization. The item is first laterally kicked off the conveyor to a staging point into a manipulator buffer guide. The item is then shoved down the guide into the manipulator chute with a two step kicking mechanization to end the selection and manipulator stages and begin the receptacle placement stage and the manipulation stage. This three step mechanization is described in more detail when FIG. 7 is discussed.

For best efficiency and safety the receptacle placement stage could begin prior to the manipulation stage in which the product item is inserted into the manipulator chute. That is, referring to FIGS. 1 and 2, an empty packing receptacle or box 20° is first positioned below and out of the orientation module 122 so that the next receptacle just doesn't fall on the floor. Empty receptacles are conveyed along an empty receptacle incoming conveyor 124 adjacent to an elevator module 126 from the input portion to the output portion which is to be further described below. When the empty receptacle is in position it is kicked (in any conventional manner) into the elevator module unit where it is conveyed by a feed conveyor 202 from an input portion to an output portion toward a receptacle handling elevator platform conveyor 204. It is at this point that the receptacle handling conveyor 204 captures the empty receptacle and then positions the receptacle appropriately such that the manipulator can place the product item into the receptacle as desired. The capturing of the receptacle and holding it in place on the platform will be described further when discussing FIG. 3.

Once insertion of the product items in the manipulator stage is complete, the full receptacle 206 is conveyed down to a full receptacle outgoing conveyor 128 which is positioned below the empty receptacle incoming conveyor. The full box is then conveyed to the appropriate area for final packing, not shown.

Figure 2:
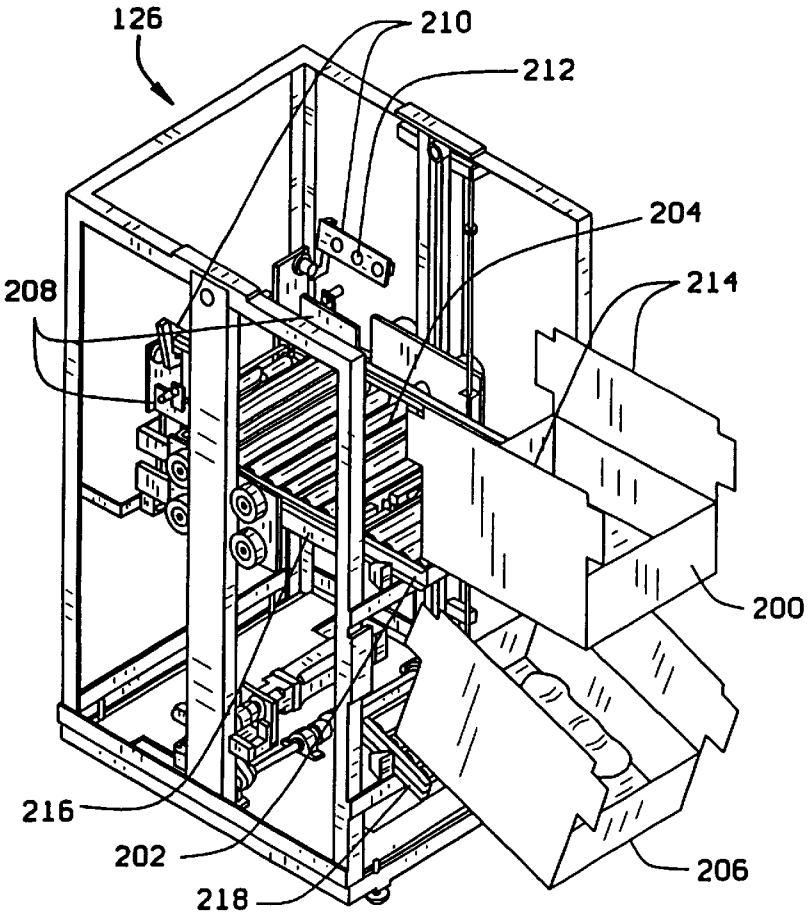
FIG. 2 shows a top-right front perspective view of the receptacle handling apparatus of FIG. 1.
Figure 3:
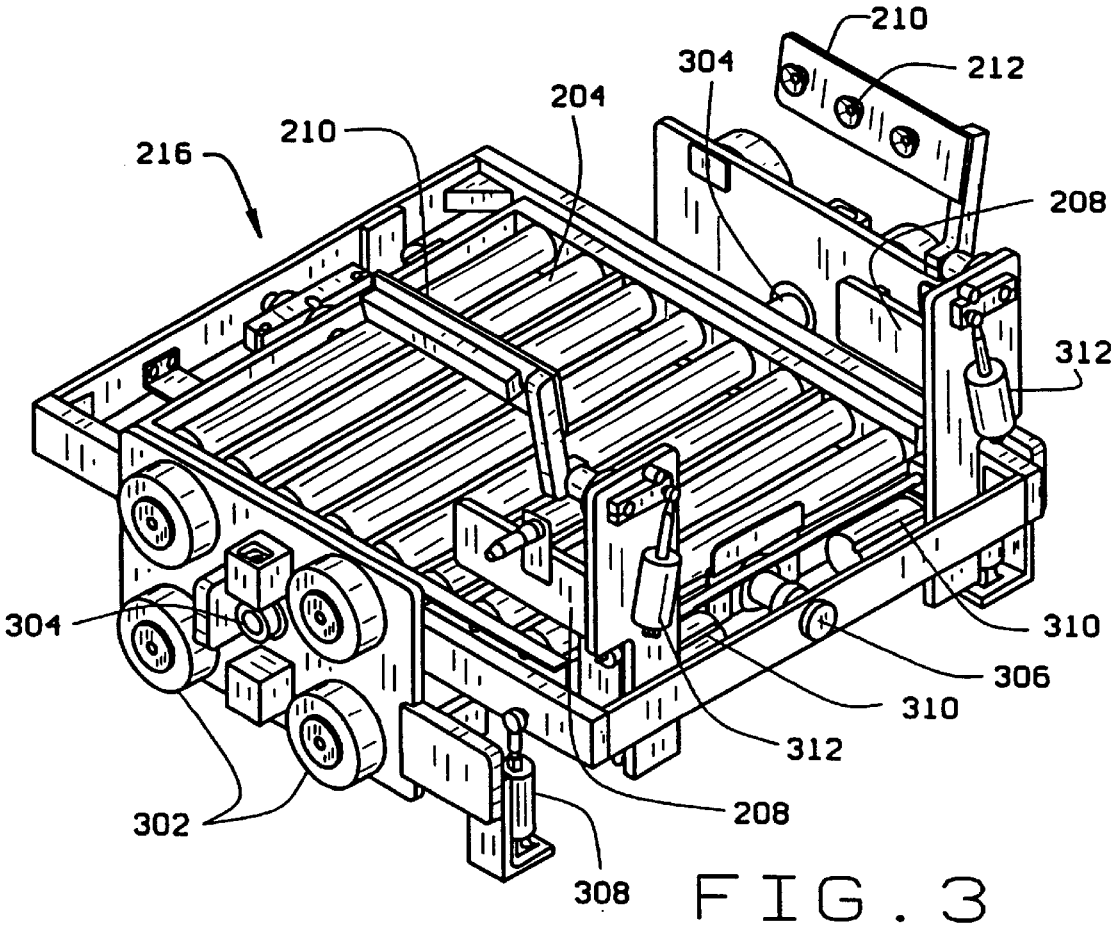
FIG. 3 shows a top-right front perspective view of the elevator platform of FIG. 1.

Referring to FIG. 2, a detailed top-right front perspective view of the receptacle elevator module 126 is shown. An empty receptacle or box 200 is shown oriented in the position just prior to being kicked into the elevator module. The empty receptacle 200 is kicked off the empty receptacle incoming conveyor 124, refer to FIG. 1, onto an empty receptacle feed conveyor 202 which conveys the receptacle onto the elevator platform conveyor 204. It is at this point that the pair of receptacle clamping arms 208 capture the empty receptacle by translating inwardly on a track rod toward the side walls of the receptacle or box and the pair of clamping arms apply pressure on opposing sides of the box thereby firmly holding the box in position. Refer to FIG. 3 for more detail. Once the box is held in position a pair of flapper members 210 each having a series of suction members 212 and each attached to one of the pair of clamping arms 208 by a pinion member flap down laterally rotating inwardly to essentially a horizontal position. Whereby, each flapper member 210 engages one of two opposing box flaps with its series of suction members 212. The flapper members then laterally rotate outwardly returning to essentially a vertical position and thereby opening the box flaps 214 to a position allowing for easy insertion of product items. The box flaps 214 are held in an open position until the packing of the box is complete at which time they are disengaged by the suction members.

Once the empty receptacle 200 has been captured by the inwardly translating grasping arm members 208, the elevator platform 216 has the ability to move up and down, to tilt front to back from about 0 to about 20°, and tilt side to side from about 0 to about 10°. Other ranges of motion could be utilized dependent on the application. This range of motion facilitates the depositing of the product items by the manipulator chute. See FIG. 3 for more detail. This completes the receptacle placement stage.

Subsequent to the placement stage or coincident with the placement stage the manipulator stage is performed where the production item is oriented to the desired position and then is deposited into the receptacle. The manipulation stage and the platform tilting portion of the placement stage are repeated until the receptacle is filled. Once an empty receptacle has been filled, the elevator platform lowers to its lowest vertical position. At this point the grasping arm members 208 release the full receptacle 206 and then the elevator platform conveyor 204 conveys the packed receptacle 206 onto the tilted full receptacle transition conveyor 218 which in turn conveys the box onto the full receptacle outgoing conveyor 128, see FIG. 1. The receptacle is then conveyed to a final packing stage.

Referring to FIG. 3, a detailed top-right front perspective view of the elevator platform 216 is shown which performs the receptacle placement. Two opposed grasping arm members 208 with actuating flapper members 210, and integral suction cups 212 are shown. Track wheels 302 are shown which provide the means for the elevator platform to travel up and down. A set of elevator platform conveyor rollers 204 is shown. The elevator platform has the ability to tilt front to back and side to side by pivoting on shaft pivots 304 and 306. The tilting motion of the elevator platform is actuated by multiple air cylinders similar to the air cylinder 308 shown. The lateral inward movement of the grasping arm members 208 are actuated by air cylinders 310 shown. The lateral inward rotational movement of the flapper members are actuated by a pair of air cylinders 312. The optional suction cups 212 can be passive suction cups or active, as shown, with attached vacuum lines (not shown).

Figure 4:
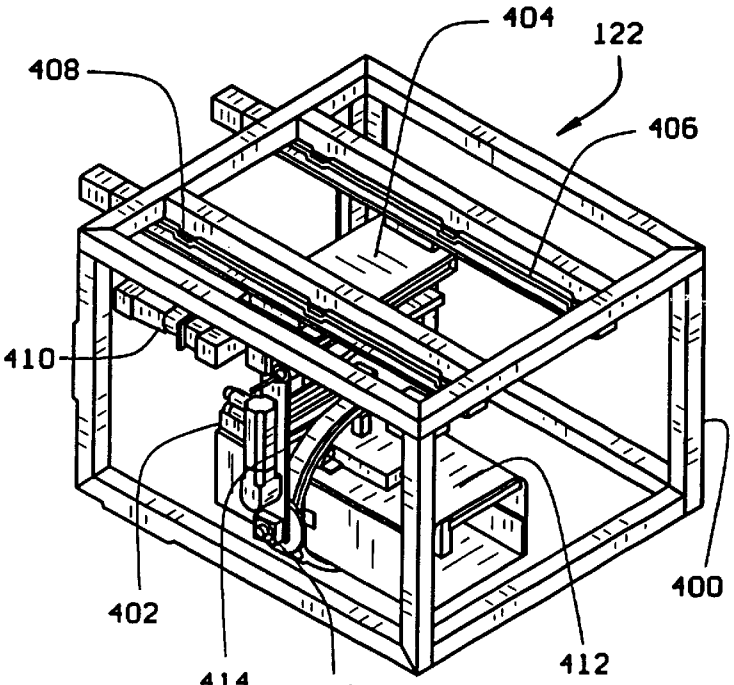
FIG. 4 shows a top-right front perspective view of the orientor module of FIG. 1.

Referring to FIG. 4, a top-right front perspective of the orientor module 122 is shown. The orientor module performs the manipulation stage of the process. The orientor module 122 comprises a metal cage frame 400 which forms a cube about the manipulator module 402 disposed within. The manipulator module 402 is capable of moving in a longitudinal direction by being attached to interface track plate 404 which translates longitudinally along guide rails 406 and 408 from 0 to about 31 inches under the force of a servo motor belt drive 410 and the manipulator module is capable of moving laterally from about −3.5 to about +3.5 inches by translating on lateral tracks on the under side of the track plate 404 under the power of a servo motor belt drive 410 or similar device.

Figure 5:
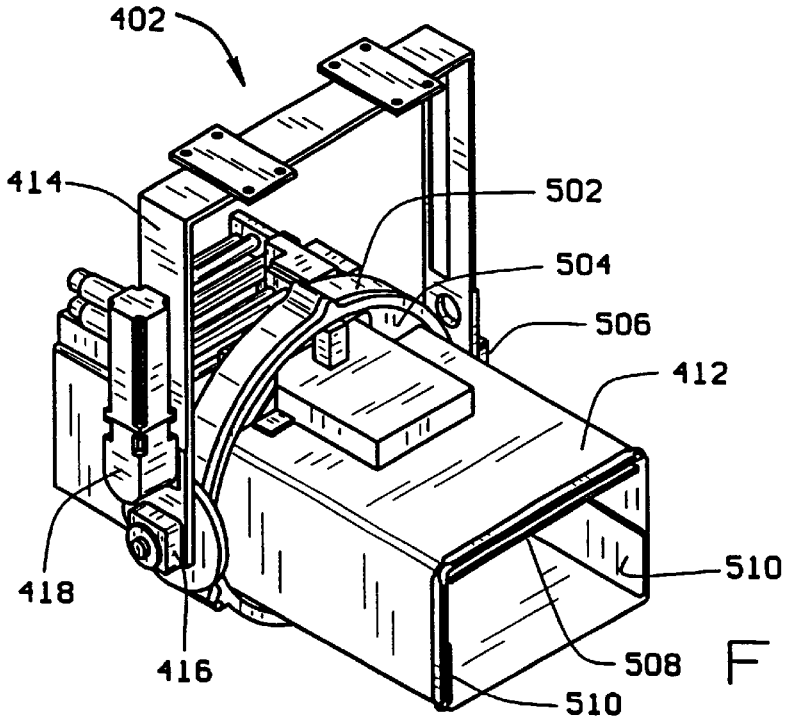
FIG. 5 shows a top-right front perspective view of the manipulator of FIG. 4.

Referring to FIGS. 4 and 5, the manipulator module unit 82 comprises a manipulator holding chute 412, a yoke bracket 414 and pinion drive 416 and motor 418 which allows the chute 412 to tilt forward from about 0 to a 90 degree angle which is one of the dimensional ranges of motion to manipulate the product item. The manipulator unit also comprises an outer stator ring 502 bracket with an internal track bearing member in which a circular inner rotor wheel 504 having a center channel that surrounds the chute member 412 can freely rotate under the force of a motor. The-manipulator unit is supported by the yoke bracket 414 and the pinion drive members 416 and 506 and the yoke bracket is attached to a track plate which in turn is attached to and translatable on track guide rails 406 and 408 of the orientor module 122.

Referring to FIG. 5, a detailed top-right front perspective view of the manipulator module unit 402 is shown. The manipulator chute has the ability to tilt front to back about the axis defined by the pair of pinion drive members 416 and 506 that mechanically connect diametrically opposing sides of the stator ring 502 to the opposing parallel legs of the U-shaped yoke bracket 414 where member 416 provides the active drive and member 506 follows. The manipulator chute 412 coaxially extends through a center channel of the surrounding rotor wheel member 504 which has the ability to rotate within a surrounding stator ring member 502. The rotation is about the cylindrical axis of the wheel and this is a second dimensional range of motion to manipulate the product. The rotor wheel can rotate from about −90° to about +90° or some other desired range depending on the application. Also, within the chute member 412 there is preferably a pressure plate 508 that applies holding pressure or other pressure applicator against a product item that has been inserted into the manipulator chute. This pressure plate holds the product item in place while the manipulator unit is operating within its programmed range of motion. In addition a similar but a smaller pair of pressure plates 510 may be integral with the opposing interior side walls adjacent to the primary pressure plate in order displace smaller items from side to side in order to properly locate.

Figure 6:
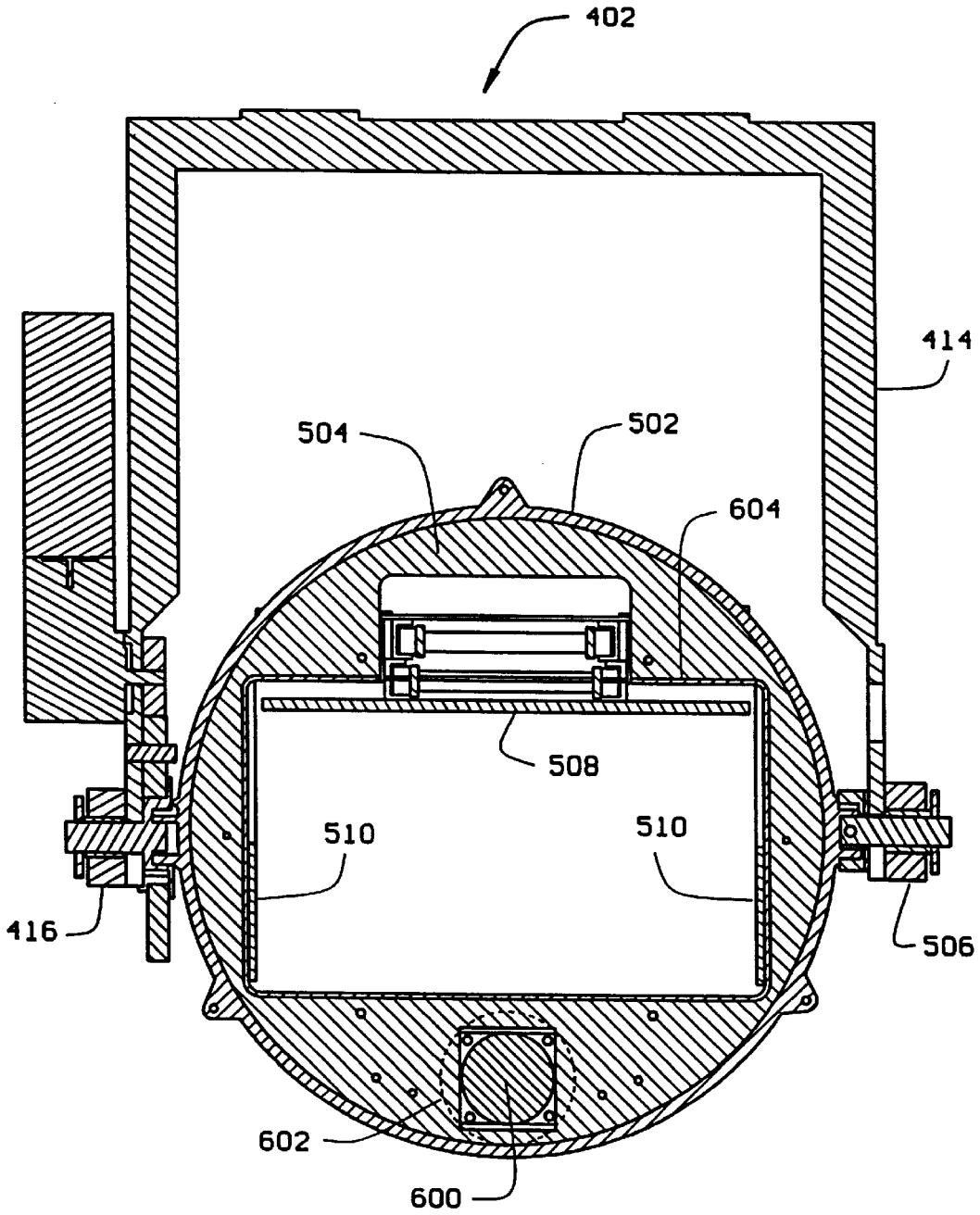
FIG. 6 shows a front vertical cross section of the manipulator.

Referring to FIG. 6, a vertical cross section of the manipulator module 402 is shown. The inverted U-shaped yoke support bracket 414 is shown. The manipulator outer stator ring 502 is laterally mounted within the U-shaped bracket 414 on pinion drive members, powered pinion member 416 and follower pinion member 506, which allows front to back tilting of the outer stator ring 502 and all hard mounted members attached thereon. The manipulator stator ring 502 is adapted with an inner track bearing member which mates to an inner rotor wheel 504 that freely rotates within the track. The rotor wheel is concentric with the outer stator ring and has an outer most diameter slightly less than the interfacing inner diameter of the track bearing member. This wheel 504 is rotated within the stator 502 by a motor 600 and drive wheel 602 (outline projection shown). The manipulator chute coaxially extends through the center channel of the wheel 604. The inwardly radially expanding bladder member and the integral horizontal pressure plate 508 is shown and the pair of vertical pressure plates 510 with their respective integral bladder members are shown. The bladder member and the pressure plate combination holds the product item in place within the chute while the desired orientation is being achieved.

Referring to FIGS. 7A to 7F, a side view of the kicker and conveying system for the product item manipulator stage and the empty receptacle placement stage in operation is shown. The kicker member 701 is a rod with a T-shaped blunt end, see FIG. 7B. The kicker 701 extends in a horizontal direction and at a right angle (laterally) to the conveyance of the product item. When the kicker 701 extends it laterally displaces the product item into the guide buffer area 702 which channels the product item into the manipulator chute 412. A pair of buffer manipulator stepped kicker devices 704 kicks the product item down the guide buffer 702 and into the manipulator chute 412. The stepped motion of the stepped kicker 704 is as follows: lowers such that the first kicking member face 703 is adjacent and to the left of the item; pushes or "kicks" the item to the right; raises; moves to the left; lower such that second kicking member face 705 is adjacent and to the left of the item; and pushes the item further to the right. The first step is into recess 707 where it is pushed by first face 703 to the right and the second step is to the right of a second face 705 as seen in FIG. 70. The stepped kicker device 704 positions first face 703 behind the product item and kicks the product item partially down the buffer guide at which point the second face member 705 of the stepped kicker device 704 positions itself behind the product item and continues to kick the product item down the buffer guide and into the manipulator chute.

Figure 7A:
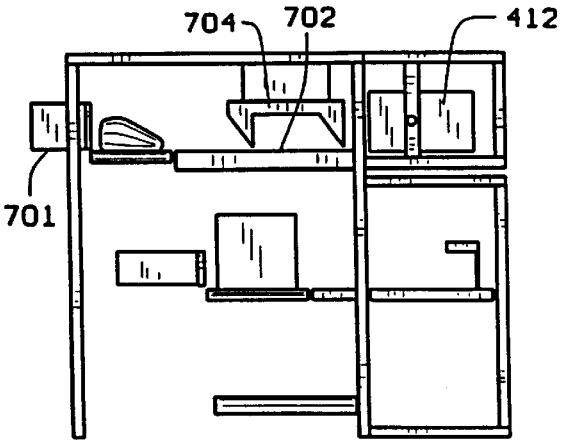
FIG. 7A shows a side view of the orientor module and the elevator module just prior to the product item and the empty receptacle being kicked laterally off their respective conveyors.
Figure 7D:
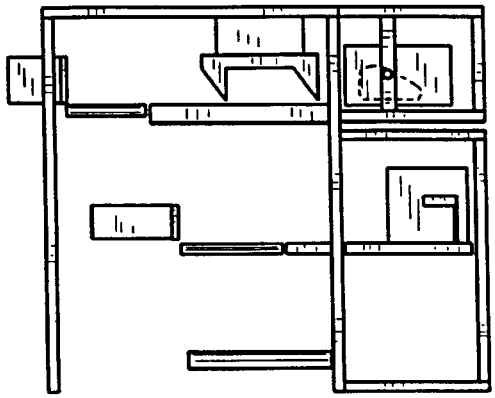
FIG. 7D shows the side view of the orientor module and the elevator module just after the product item has been kicked into the manipulator kicker chute.

Once the product item is in the manipulator chute 90 (see FIGS. 7A and 7D) the manipulator orients the item as desired and then the item is dropped (see FIG. 7E) into the receptacle 200. The meat is shown in FIGS. 7D–7F as not being rotated, but could be inverted. Prior to dropping the product item the receptacle 200 is positioned by a kicker on the elevator platform 216 and the platform has oriented the receptacle accordingly. FIG. 7A shows a side view of the orientor module and the elevator module just prior to the product item and the empty receptacle being kicked laterally off their respective conveyors.

Figure 7B:
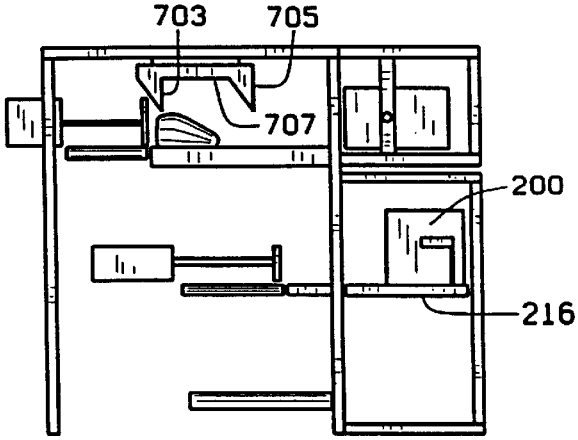
FIG. 7B shows the side view of the orientor module and the elevator module just after the product item and the receptacle have been kicked laterally off their respective conveyors.
Figure 7E:
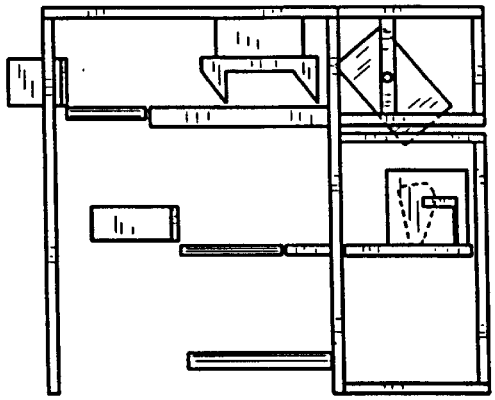
FIG. 7E shows the side view of the orientor module and the elevator module just after the product item has been deposited into the receptacle.

Referring to FIG. 7B, the side view of the orientor module and the elevator module is shown just after the product item and the receptacle have been kicked laterally off their respective conveyors by kicker 701 but before being pushed by step kicker device 704.

Figure 7C:
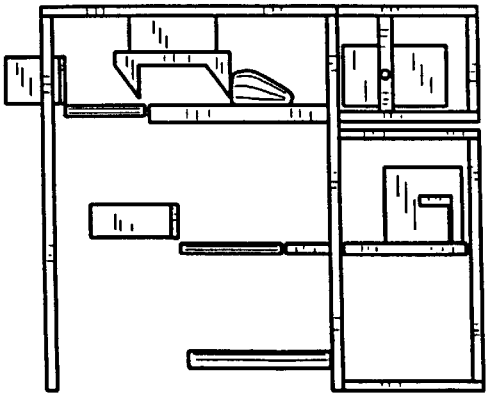
FIG. 7C shows the side view of the orientor module and the elevator module just prior to the product item being kicked into the manipulator chute.
Figure 7F:
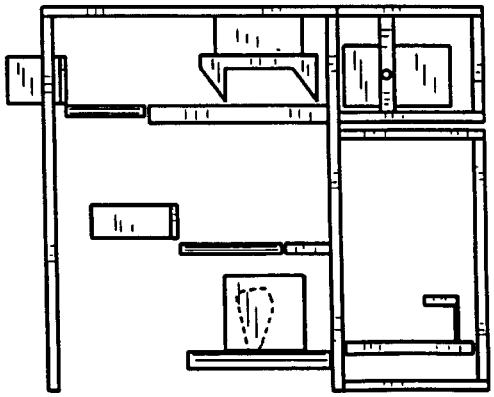
FIG. 7F shows the side view of the orientor module and the elevator module just after the receptacle has been conveyed on to the outgoing receptacle conveyor.

Referring to FIG. 7C, the side view of the orientor module and the elevator module is shown just prior to the product item being kicked into the manipulator chute.

Referring to FIG. 7D, the side view of the orientor module and the elevator module is shown just after the product item has been kicked into the manipulator kicker chute.

Referring to FIG. 7E, the side view of the orientor module and the elevator module is shown just after the product item has been deposited into the receptacle.

Referring to FIG. 7F, the side view of the orientor module and the elevator module is shown just after the receptacle has been conveyed on to the outgoing receptacle conveyor.

Figure 8A:
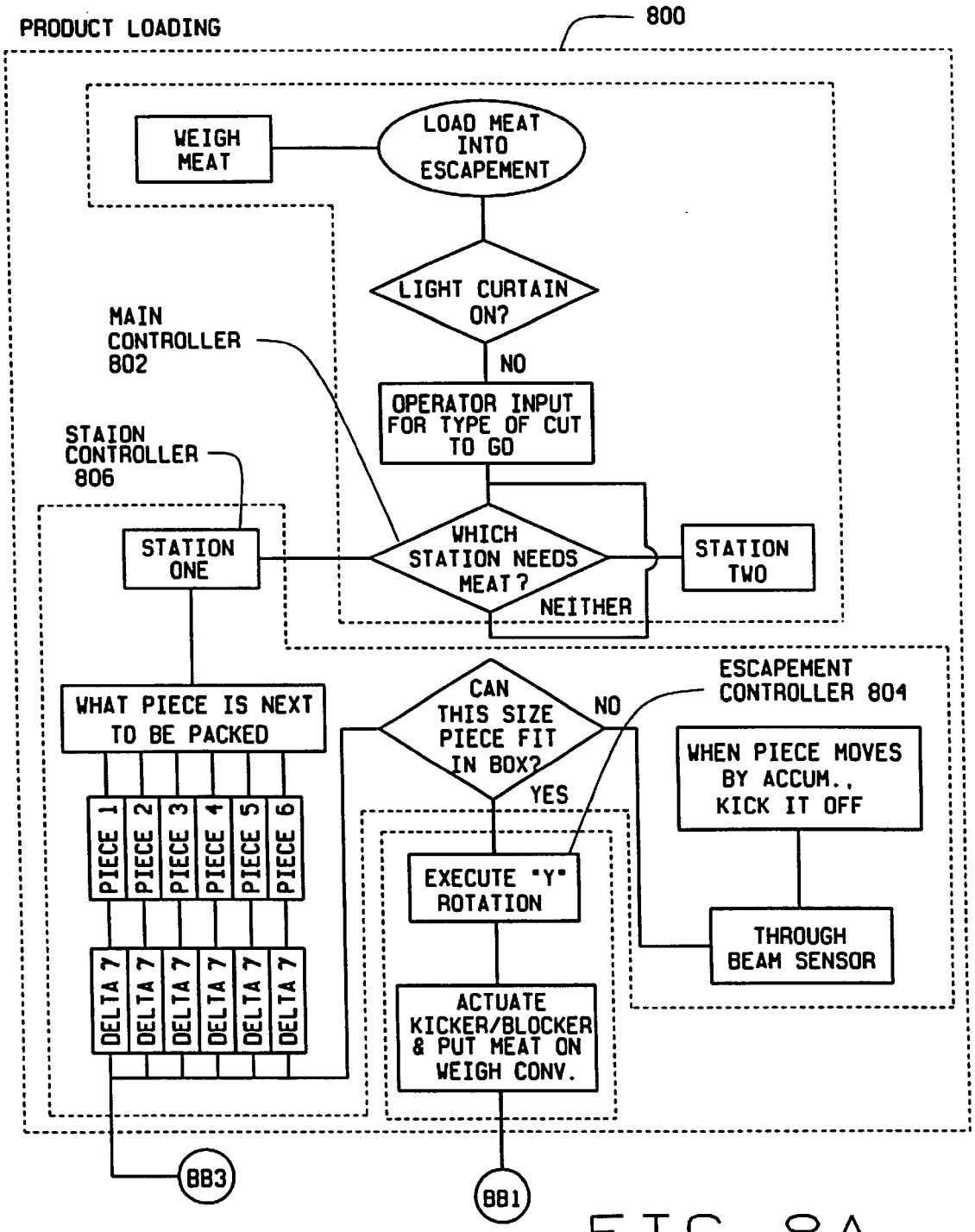
FIG. 8A shows a flow diagram of the product item handling control functions.
Figure 8B:
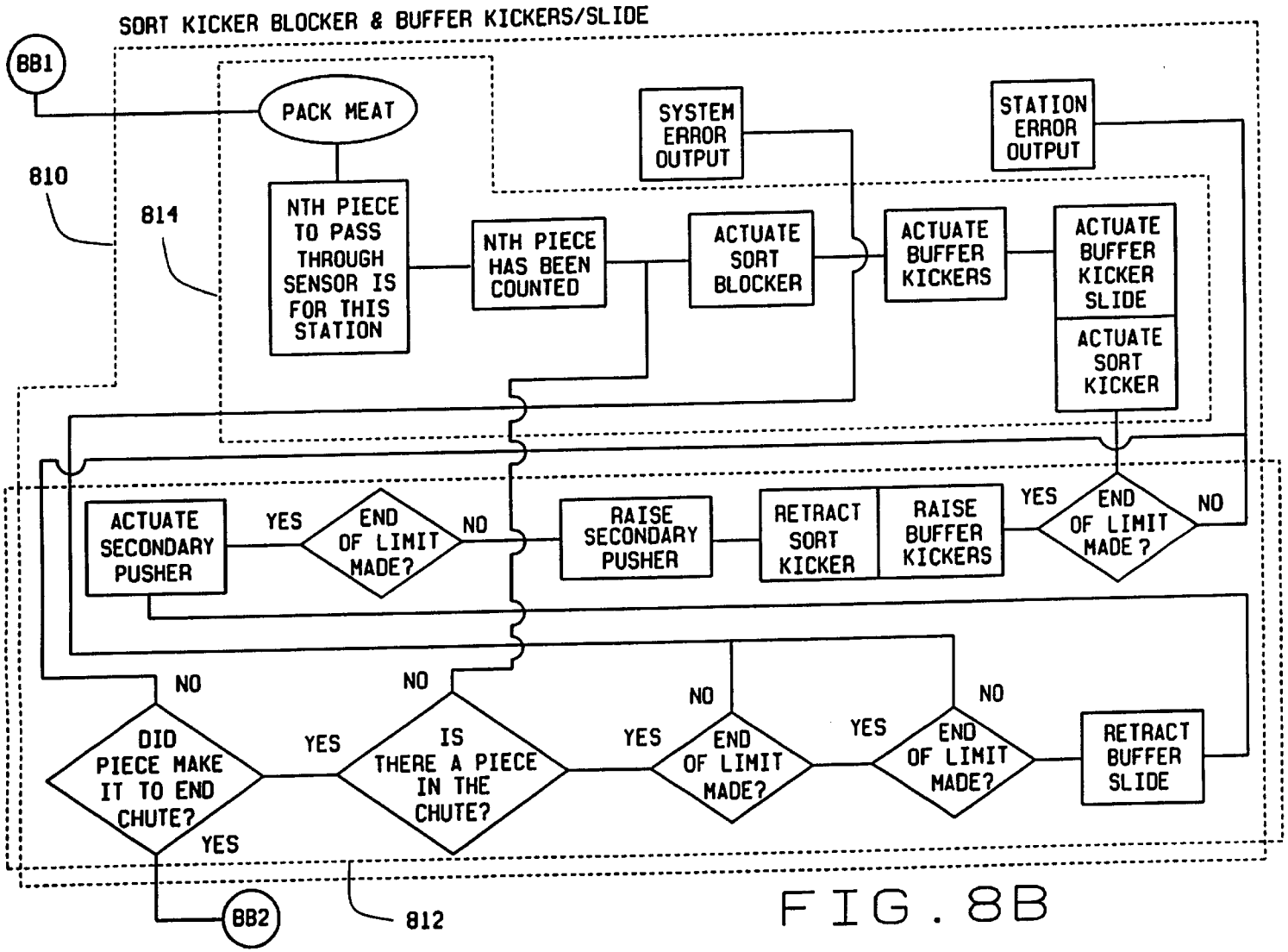
FIG. 8B shows a flow diagram of the receptacle handling control functions.
Figure 8C:
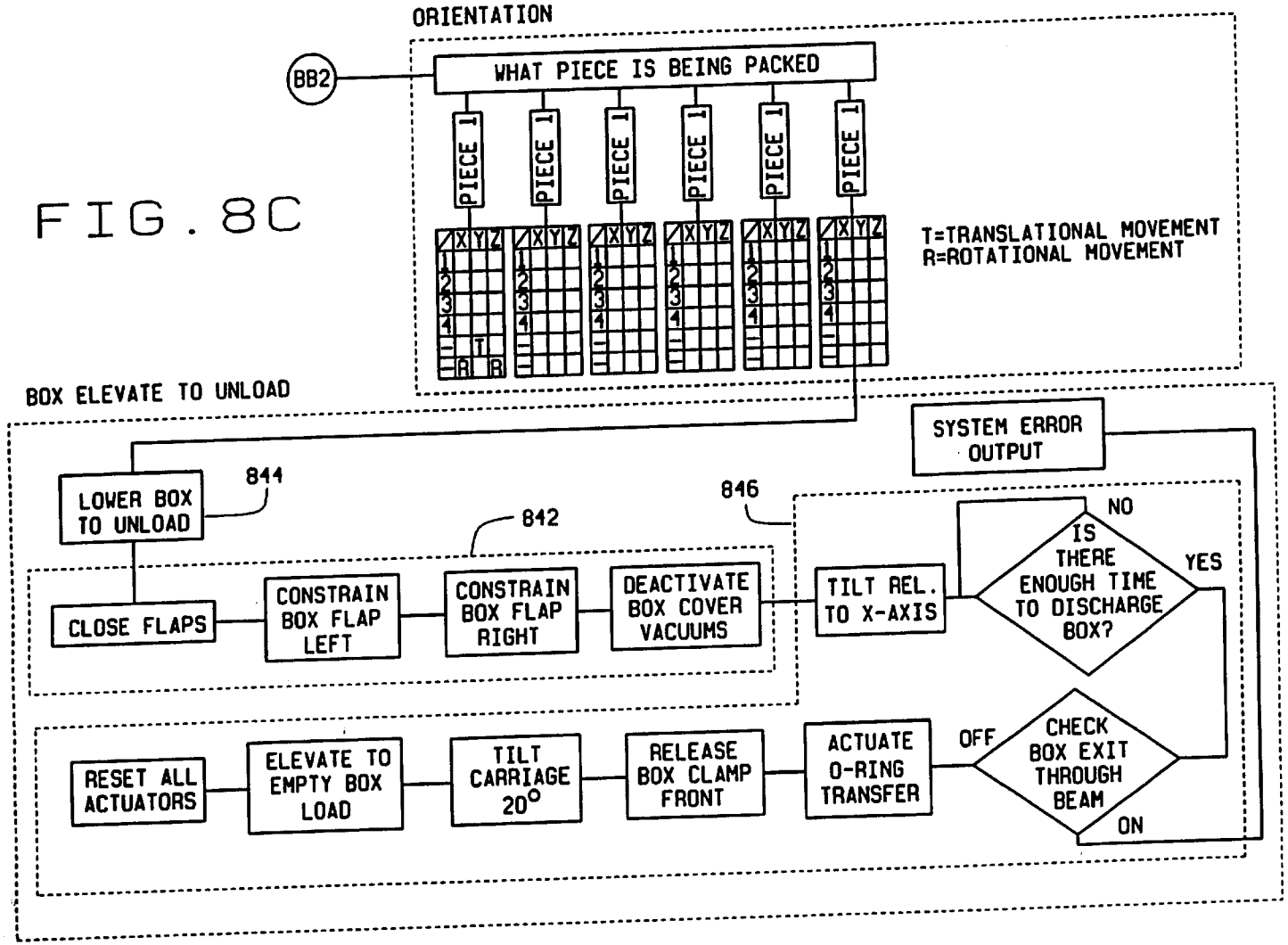
FIG. 8C shows a flow diagram of the orientation and elevate control functions.
Figure 8D:
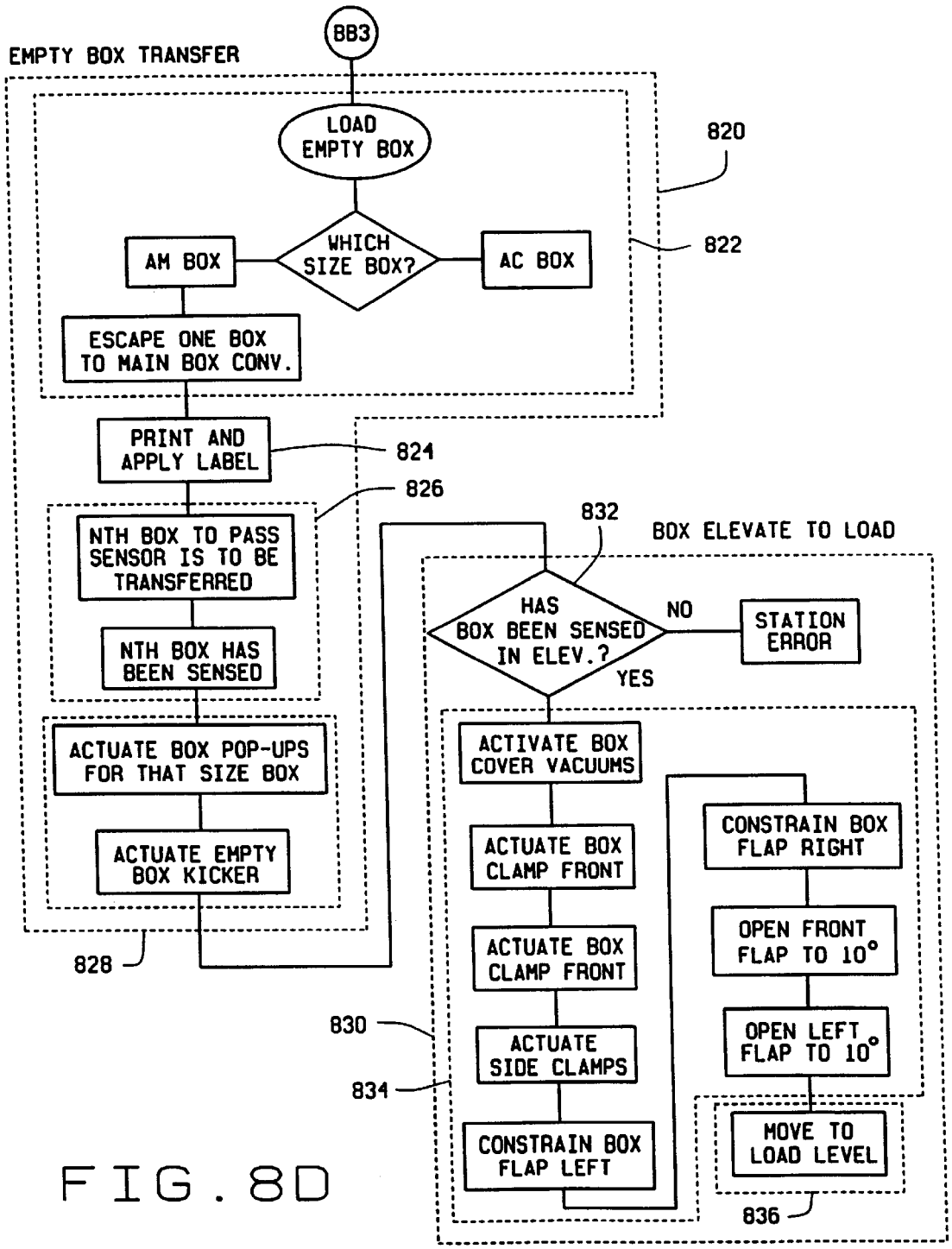
FIG. 8D shows a flow diagram of the empty box transfer control functions.

Referring to FIGS. 8A and 8D, a flow diagram of the product item loading, sorting and orienting controller, the empty box transfer, loading, and unloading functions are shown.

The product loading functional module 800 comprises three sub modules, the main operator controller module 802, the escapement controller module 804 and the station controller module 806. The main operator controller module 802 receives inputs entered by the operator for the type of cut of meat and the weight. If this invention is utilized for product items that are not sub-primal cuts of meat then the product item can be identified by a different module (not shown). This input will be utilized by this module to select the receptacle type, the orientation routine, and the manipulator station. The station controller and main controller module 806 tracks what product item is being packed and the next item to be packed. The station controller also determines if a receptacle is loaded and if so can it accommodate the next product item to be packed. If the next product item can not be accommodated by the receptacle currently loaded then the product item is kicked off the conveyor as it moves past the accumulation station. However, if no receptacle has been loaded then receptacle loading is initiated. The escapement controller module 804 provides the control function for orientation of the product item prior to laterally displacing the item on to the conveyor and initiates weighing and optional labeling (not shown in flow chart) of the item.

The sorting functional module 810 comprises two sub functional modules, the buffer kicker module 812 and the manipulator sorter module 814. The kicker module 812 controls the actuation and control of the buffer kickers. The sorter module 814 controls the actuation of the manipulator sorter kicker and the selection stage manipulator sorter blocking plate.

The orientation module 816 receives inputs from the main controller and the station controller indicating the type of meat that has just been loaded in the chute and the nth product item count. Then the appropriate orientation routine is performed to achieve the desired translational and rotational movement of the manipulator.

The empty box transfer module 820 has four sub modules, the escapement module 822, the labeling module 824, the sensing module 826 and the actuate module 828. The empty box transfer module 820 is initiated when an input is received from the product loading module 800 indicating that a product item is in queue. The escapement module 822 controls the release of an empty receptacle to the main empty receptacle incoming conveyor. The receptacle is released once this module determines the box size required based on operator input. The Labeling module 824 labels the receptacle to identify the product items. The sensing module 826 keeps track of the number of receptacles that have been transferred. The actuate module 828 controls the kicking of the receptacle in-to the appropriate receptacle handling elevator.

The box loading module 830 comprises three sub modules the sensing module 832, the clamping module 834, and the elevate to load level module 836. The sensing module 832 receives an input from a sensor that senses when a receptacle is present on the elevator platform and provides an initiation output to initiate the clamping of the receptacle. The clamping module 834 actuates the vacuums and the clamping arms. The elevate to load level module 836 moves the receptacle to the loading level and tilts the receptacle to the appropriate orientation for the given packing sequence.

The box unload module 840 comprises three sub modules the deactivate vacuum module 842, the elevate module 844, and the tilt and release module 846. The deactivate vacuum module 842 deactivates the vacuums when the packing sequence is complete. The elevate module 844 lowers the receptacle to the receptacle discharge level. The tilt and release module 846 actuates the release of the clamping arms and tilts the elevator platform to translate the receptacle to the outgoing full receptacle conveyor.

In view of the foregoing, it will be seen that the stated objects of the invention are achieved. The above description explains the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description shall be interpreted as illustrative rather than limiting. Thus, the breadth and scope of the present invention should not be limited by any of the above-described exemplary embodiments, but should be defined only in accordance with the following claims appended hereto and their equivalents.

All patents, if any, referenced herein are incorporated in their entirety for purposes of background information and additional enablement.

What is claimed is:

1. An item handling system, comprising:

a receptacle incoming conveyor having an input portion and an output portion;

a kicking apparatus adapted to laterally extend across the receptacle incoming conveyor output portion to laterally displace a receptacle off the conveyor;

a platform adjacent the incoming conveyor and having an integral conveyor communicable with the incoming conveyor and adapted to receive laterally displaced receptacles from the incoming conveyor;

a first shaft pivot member axially connected to the platform about which the platform may tilt;

a second shaft pivot member axially connected to the platform and perpendicular to the first shaft pivot member and about which the platform may tilt;

a pair of opposing grasping mechanical arm members operably connected to the platform where each member is operable to translate inward along a track rod adapted to clamp a receptacle when placed on the platform; and a pair of flapper members each attached to one of the opposing pair of arm members by a pinion member and laterally rotatable about said pinion member and each flapper having a series of integral suction members adapted to engage a pair of receptacle cover flaps.

2. The item handling system of claim 1, wherein the elevator platform is adapted to tilt by an amount of about 20° on the first shaft pivot.

3. The item handling system of claim 2, wherein the elevator platform is adapted to tilt by an amount within a range of about 10° on the second shaft pivot.

4. The item handling system of claim 1, wherein the series of suction members are suction cups for grasping the receptacle's cover flaps.

5. A receptacle handling apparatus comprising:

an elevator platform;

a first shaft pivot member about which the elevator platform can tilt;

a second pivot member perpendicular to the first pivot member about which the elevator platform can tilt an elevator lift drive;

a conveyor integral with said platform; and a pair of mechanical arms adapted to grasp items resting on said platform.

6. The receptacle handling apparatus of claim 5, where said elevator platform can pivot in a range of about 20° about the first shaft pivot member.

7. The receptacle handling apparatus of claim 5, where said elevator platform can pivot in a range of about 10° about the second shaft pivot member.

8. An item handling system, comprising:

an elevator platform having a main portion and a transition portion pivotally attached thereto for pivoting downward to discharge a receptacle where a substantial portion of the main portion and the transition portion of the platform is an integral conveyor;

a pair of opposing grasping mechanical arm members operably connected to the elevator platform where each member is operable to translate inward along a track;

a pair of flapper members each attached to one of the opposing pair of opposing grasping arm members by a pinion member and laterally rotatable about said pinion member and each flapper having a series of integral suction members adapted to engage a receptacle cover flap.

9. The item handling system as recited in claim 8 further comprising:

a first shaft pivot member axially connected to the elevator platform about which the platform can tilt;

a second shaft pivot member axially connected to the elevator platform and perpendicular to the first shaft pivot member and about which the elevator platform can tilt.

10. The item handling system as recited in claim 9 wherein the elevator platform is adapted to tilt by an amount of about 20° on the first shaft pivot.

11. The item handling system as recited in claim 10 wherein the elevator platform is adapted to tilt by an amount within a range of about 10° on the second shaft pivot.

12. The item handling system as recited in claim 8 wherein the series of suction members are suction cups for grasping the receptacle's cover flaps.

13. The item handling system of claim 8 where said elevator platform is operable to translate vertically along an elevator rail on axially attached track wheels.

* * * * *